US006619869B1

(12) United States Patent
Huang et al.

(10) Patent No.: US 6,619,869 B1
(45) Date of Patent: Sep. 16, 2003

(54) METHOD FOR GENERATING A MATTE FINISH ON A PHOTO PICTURE USING A THERMAL PRINTER

(75) Inventors: Kuan-Chih Huang, Taipei Hsien (TW); Hsu-Chu Chien, Taipei (TW)

(73) Assignee: Hi-Touch Imaging Technologies Co., Ltd., Pan-Chiao (TW)

( * ) Notice: Subject to any disclaimer, the term of this patent is extended or adjusted under 35 U.S.C. 154(b) by 0 days.

(21) Appl. No.: 10/065,666

(22) Filed: Nov. 7, 2002

Related U.S. Application Data

(63) Continuation-in-part of application No. 10/063,886, filed on May 21, 2002.

(51) Int. Cl.[7] ..... B41J 2/315

(52) U.S. Cl. ..... 400/120.01; 400/120.02; 400/120.18; 347/171; 347/212

(58) Field of Search ..... 400/120.01–120.08, 400/120.18; 347/171, 204, 205, 212

(56) References Cited

U.S. PATENT DOCUMENTS 4,694,354 A * 9/1987 Tanaka et al. ..... 358/296
5,502,555 A * 3/1996 Lakatos ..... 399/140
6,031,556 A 2/2000 Tutt et al. ..... 347/212
6,184,181 B1 2/2001 Lum et al. ..... 503/227
6,194,348 B1 2/2001 Onishi et al. ..... 503/227
6,228,805 B1 5/2001 Ohshima et al. ..... 503/227

FOREIGN PATENT DOCUMENTS

JP 08108643 A * 4/1996 ..... B41M/5/40

* cited by examiner

*Primary Examiner*—Andrew H. Hirshfeld
*Assistant Examiner*—Minh Chau
(74) *Attorney, Agent, or Firm*—Winston Hsu

(57) ABSTRACT

A method for generating a matte finish on a photo picture using a thermal printer includes using the thermal printhead to heat different areas of an overcoating dye frame of an ink ribbon by at least two distinct time periods to dispose overcoating on the photo picture. The two distinct time periods are a first time period and a second time period; the first time period disposing thicker layer of overcoating than the second time period. A matte finish pattern of overcoating comprises a two-dimensional array of cells wherein each cell is heated by either the first time period or the second time period based on a substantially random probability.

6 Claims, 4 Drawing Sheets

METHOD FOR GENERATING A MATTE FINISH ON A PHOTO PICTURE USING A THERMAL PRINTER

CROSS REFERENCE TO RELATED APPLICATIONS

This is a continuation-in-part of application Ser. No. 10/063,886, filed May 21, 2002, which is included in its entirety herein by reference.

BACKGROUND OF INVENTION

1. Field of the Invention

The present invention relates to a method of printing a photo picture using a thermal printer, and more particularly, to a method for forming a matte finish on a photo picture using a thermal printer.

2. Description of the Prior Art

Two typical finishes for conventional film photographs are a glossy finish and a matte finish. Technology has developed to an extent where digital pictures taken by a digital camera can be printed using a thermal printer for a reasonable cost. While a glossy finish can be easily realized by forming a uniform over coating layer on top of the picture after colored dye is printed, a matte finish cannot be made this way. A matte finish is typically only achievable using photo processing techniques developed for conventional film photographs.

Consider a conventional film photograph 10 as shown in FIG. 1. A piece of photographic paper 12 has a developed image that is covered by a protective over coating 14. The over coating 14 is textured with tiny rounded protuberances (size exaggerated in FIG. 1). The effect is one that is familiar to anyone who has ever looked at a photograph having a matte finish. Incident light is reflected in such a way that the image on the paper 12 appears non-glossy-evenly reflecting illuminating light.

Currently, there is no suitable way of giving a digital photograph printed with a thermal printer a matte finish. This is a shortcoming of the present state of the art as more and more photographers are printing their own digital pictures without going to a third party photo developer.

SUMMARY OF INVENTION

It is therefore a primary objective of the claimed invention to provide a method for generating a matte finish on a photo picture using a thermal printer.

Briefly summarized, the claimed invention includes using a thermal printhead to heat different areas of an overcoating dye frame of an ink ribbon by at least two distinct time periods to form a matte finish pattern of disposed overcoating on a photo picture. The two distinct time periods being a first time period and a second time period. The matte finish pattern comprising a two-dimensional array of cells wherein each cell is heated by either the first time period or the second time period.

According to the claimed invention, the first time period is longer than the second time period, and the first time period causes the overcoating to be disposed on the photo picture in a layer that is thicker than a layer of overcoating disposed by the second time period.

It is an advantage of the claimed invention that the overcoating is disposed according to the two distinct time periods to give the photo picture a matte finish.

It is a further advantage of the claimed invention that a photographer can print a digital photograph having a matte finish, without requiring a third party photo developer.

These and other objectives of the claimed invention will no doubt become obvious to those of ordinary skill in the art after reading the following detailed description of the preferred embodiment that is illustrated in the various figures and drawings.

DETAILED DESCRIPTION

Figure 2:
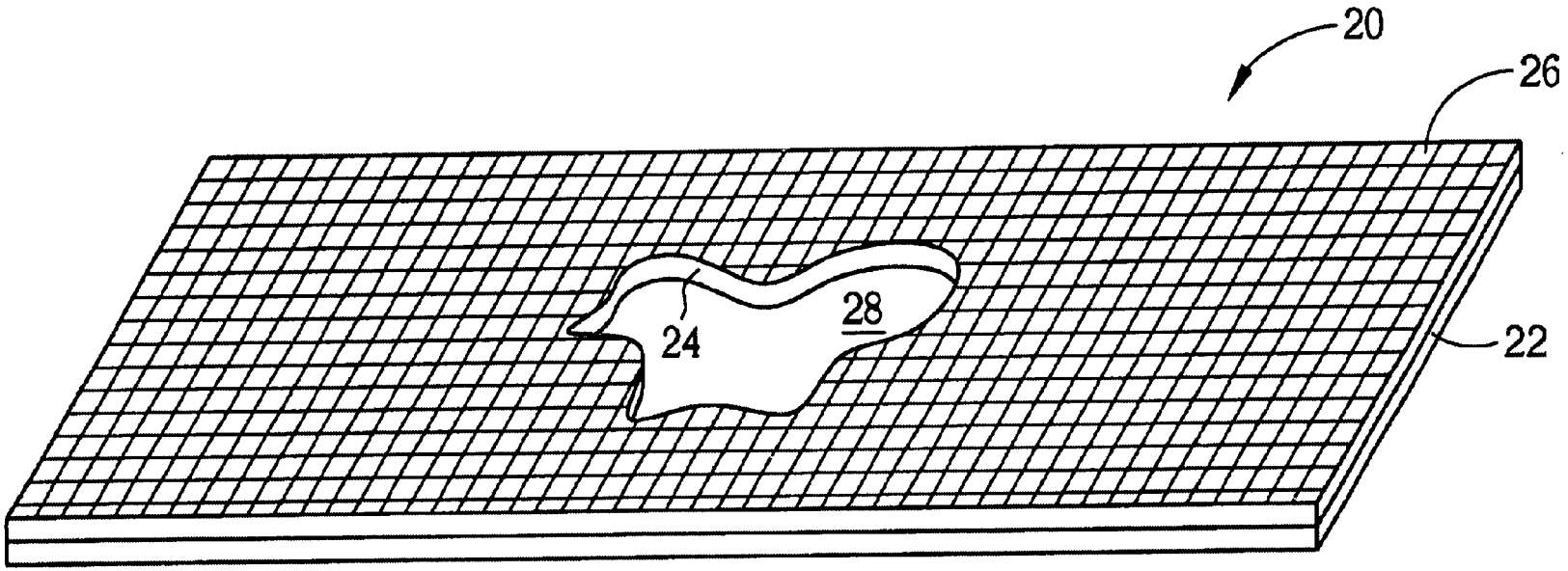
FIG. 2 is a schematic diagram of a photo picture according to the present invention.

Please refer to FIG. 2 showing a digital photo picture 20 as printed with a-thermal printer. The picture 20 includes a print medium 22 that is a special paper compatible with printing dye used by the thermal printer. After the picture 20 has had dye printed on a top surface 28 of the medium 22, an over coating layer 24 is disposed over the top surface 28 to protect the dye from moisture and other causes of deterioration. It is well know that the over coating 24 can be evenly disposed in a layer of substantially uniform thickness to provide protection and to impart a glossy finish to the picture 20. The present invention method divides the over coating 24 into a logical two-dimensional array 26 and disposes over coating of at least two different thicknesses in each cell (or pixel) of the array 26 according-to a matte finish pattern. Note that the array 26 and its cells are not physical entities. Furthermore, for explanatory purposes, sizes of the cells of the array 26 shown in FIG. 2 are exaggerated.

Figure 3:
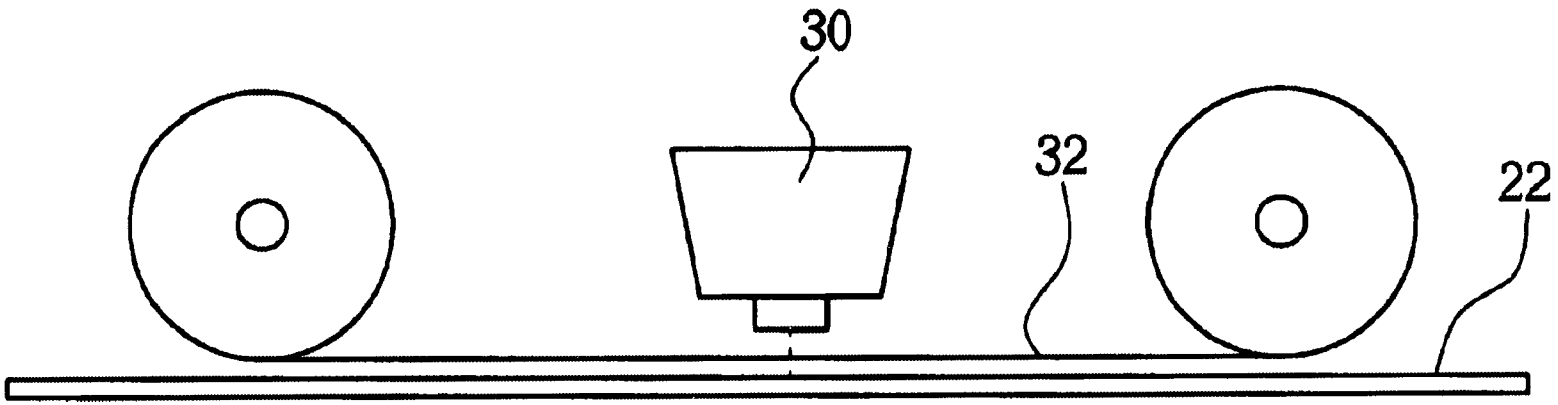
FIG. 3 is a schematic diagram of a thermal printhead and ink ribbon for printing to a medium.

Referring to FIG. 3, a thermal printhead 30 heats a dye frame containing layered over coating of a cassette mounted printing ribbon 32 to transfer over coating to the print medium 22. The printhead 30, ribbon 32, and print medium 22 all move relative to each other to accomplish this in an efficient manner as is known in the art. As mentioned above, the printhead 30 can heat the over coating layer on the ribbon 32 uniformly over time to give a glossy finish to the picture 20. According to the preferred embodiment of the present invention, the printhead 30 is capable of heating the over coating layer of the ribbon 32 by two distinct time periods to dispose over coating of two distinct thicknesses. In the arrangement shown in FIG. 3, a longer heating time yields a thicker layer of disposed over coating.

Figure 4:
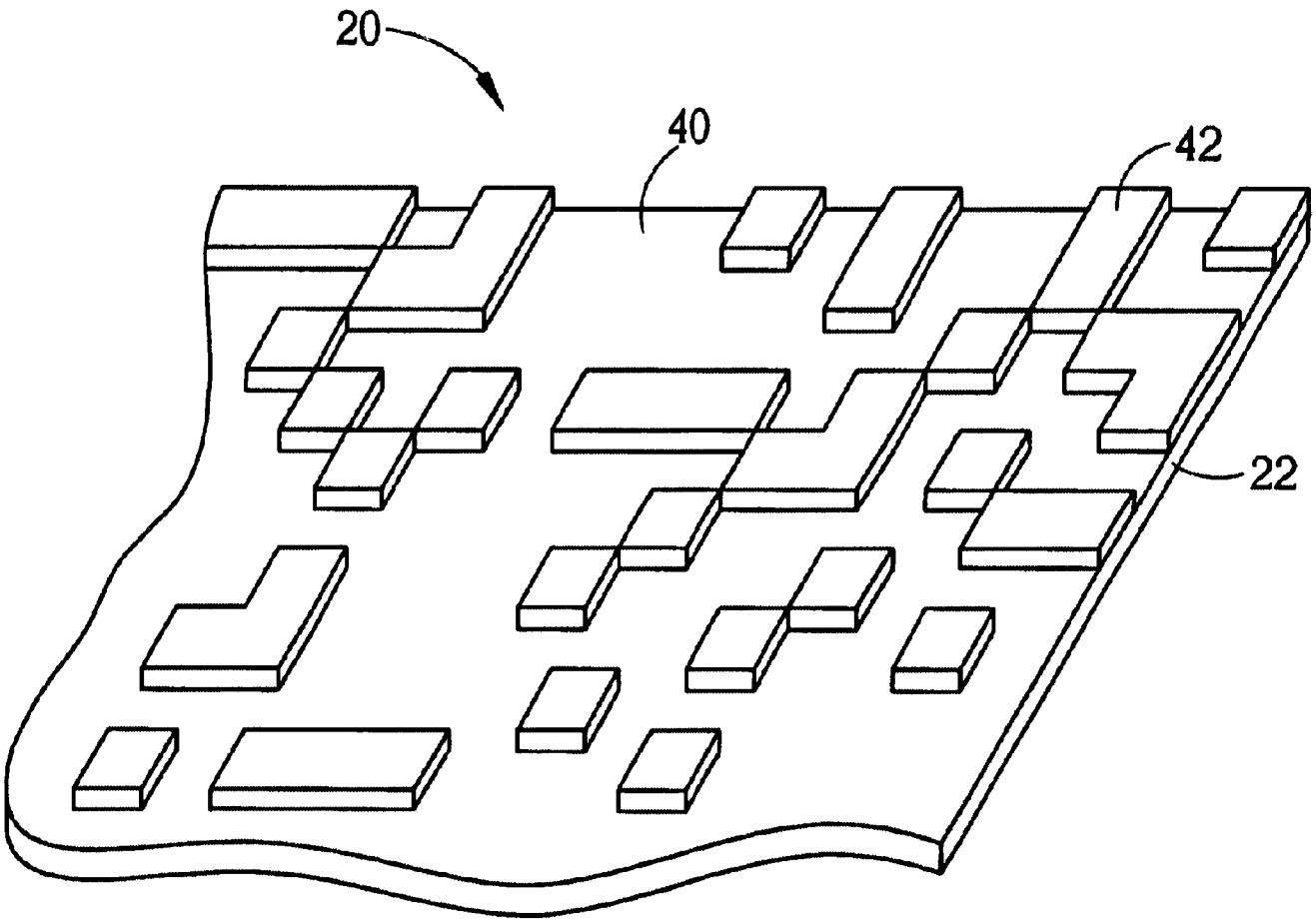
FIG. 4 is a magnified view of a region of the photo picture of FIG. 2.

Please refer to FIG. 4. FIG. 4 shows a magnified view of a region of the picture 20. Following the layout of the two-dimensional array 26 of FIG. 2, the printhead 30 disposes regions of thick and thin over coating by providing heat for a first and a second time period respectively. The longer first timer period disposes thicker regions of over coating, and the shorter second timer period disposes regions that are thinner. The thermal printhead 30, as well as thermal printheads of other designs, is capable of heating the cells of the logical array 26 by differing amounts in much the same way as it heats colored printing dye to print pixels of an image. FIG. 4 illustrates, for example, a thin region of over coating 40 and a thick region of over coating 42 on the print medium 22. These thick and thin cells are distributed randomly over the top surface 28 of the print medium 22. A suitable random distribution is: for a given cell there is a 50% probability that either a thick or a thin layer of over coating will be disposed. A shape of the disposed over coating cells 40 and 42 is nominally square, however, this is mostly dependent on a design of the printhead 30. In practical application, the shape of the over coating cells 40 and 42 is not limited; with squares or rounded-corner squares being most viable.

When viewed, the picture 20 undergoing the above-described method of the present invention is given a matte finish that is comparable to a conventional film print matte finish. Parameters-such as the first and second time periods, and the size and shape of the cells of the array 26 can be configured to emulate or even to surpass the matte effect of conventional film prints. For example, a random distribution of 50% thick/50% thin with a nominal square cell pitch of 150 DPI will yield a matte effect different from employing a 60% thick/40% thin distribution 300 DPI cell pitch. Other parameters such as quality and reflectance of the print medium 22 are also necessary to be considered. Regardless of the specific parameter values, the random pattern must be suitably random so that a viewer of the picture 20 will not perceive any visual distortion, uneven reflectance, or undesirable flaw. Furthermore, the pitch of the cells must be fine enough to impart the matte finish; as too rough a pitch will not yield a matte effect.

Figure 1:
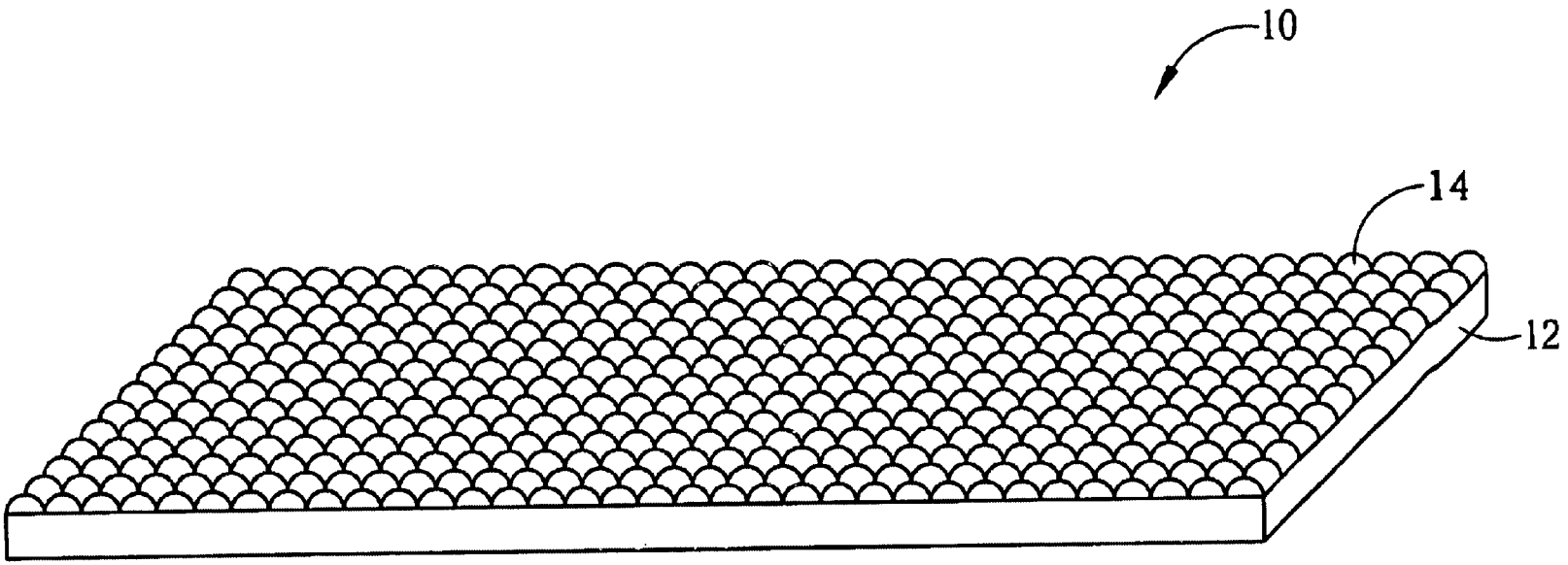
Fig. 1 Prior art
FIG. 1 is a schematic diagram of a conventional film photograph having a matte finish.

The two distinct time periods, the first and the second, are selected and discussed in the preferred embodiment as exemplary. Using three or more distinct time periods to dispose three or more corresponding distinct thicknesses of over coating according to the method of the present invention can further provide an enhanced matte effect. If desirable, the protuberances of over coating 14 of the conventional matte finish of the photograph 10 (FIG. 1) can be closely approximated by using a plurality of distinct time periods. The quantity of time periods and a specific duration of each are left to a designer or a user to select based on considerations such as a cost of the thermal printer, a disposing time of a matte finish onto a picture, and a desired visual quality of matte finish. If higher cost and slower printing times can be tolerated or eliminated, improved visual quality of the matte finish may be realized by using more than two distinct time periods.

In practical application, the present invention method can be realized with existing thermal printer hardware components such as logic circuits and microcontrollers, and through software controlling these components.

In contrast to the prior art, the present invention method can be applied by a thermal printer to give a printed photo picture a matte finish. This gives photographers an opportunity to print matte finish digital photos without having to use a third party developer, thus offering photographers a convenient and cost effective alternative.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A method for generating a matte finish on a photo picture using a thermal printer; the thermal printer comprising a thermal printhead for heating an ink ribbon and generating an image through the ink ribbon on a photo picture; the ink ribbon comprising a plurality of sequentially arranged color frames, each color frame comprising a plurality of dye frames with different color dyes and a dye frame with overcoating; the method comprising: using the thermal printhead to heat a color frame with a plurality of different color dyes and to sublimate the color dyes on a photo picture; and using the thermal printhead to heat different areas of the overcoating dye frame by at least two distinct time periods to form a matte finish pattern of disposed overcoating on the photo picture, the two distinct time periods being a first time period and a second time period, the matte finish pattern of overcoating comprises a two-dimensional array of cells wherein each cell is heated by either the first time period or the second time period.

2. The method of claim 1 wherein the first time period is longer than the second time period, and the first time period causes the overcoating to be disposed on the photo picture in a layer that is thicker than a layer of overcoating caused by the second time period.

3. The method of claim 1 wherein the first and second time periods are capable of being adjusted to form different qualities of matte finish on the photo picture.

4. The method of claim 1 wherein each cell of the array is rectangular in shape, and each cell has a length and a width that are capable of being adjusted to form different qualities of matte finish on the photo picture.

5. The method of claim 1 wherein the cells are at a pitch of approximately 150–600 DPI.

6. A thermal printer for generating a matte finish on a photo picture, the thermal printer comprising a thermal prinhead for heating an ink ribbon and generating an image through the ink ribbon on a photo picture; the ink ribbon comprising a plurality of sequentially arranged color frames, each color frame comprising a plurality of dye frames with different color dyes and a dye frame with overcoating; the thermal printer comprising the thermal printhead means to heat a color frame with a plurality of different color dyes and to sublimate the color dyes on a photo picture, and to heat different areas of the overcoating dye frame by at least two distinct time periods to form a matte finish pattern of disposed overcoating on the photo picture, the two distinct time periods being a first time period and a second time period, the matte finish pattern of overcoating comprises a two-dimensional array of cells wherein each cell is heated by either the first time period or the second time period.

* * * * *